US005392059A

United States Patent [19]

Ueno et al.

[11] Patent Number: 5,392,059

[45] Date of Patent: Feb. 21, 1995

[54] IMAGE FORMING METHOD USING THERMAL TRANSFER

[75] Inventors: Takeshi Ueno; Katsuyuki Oshima; Hidetake Takahara; Jitsuhiko Ando; Mineo Yamauchi, all of Tokyo, Japan

[73] Assignee: Dai Nippon Printing Co., Ltd., Japan

[21] Appl. No.: 880,657

[22] Filed: May 11, 1992

[30] Foreign Application Priority Data

May 13, 1991 [JP] Japan ..... 3-135236
Jul. 3, 1991 [JP] Japan ..... 3-188286
Oct. 9, 1991 [JP] Japan ..... 3-289439

[51] Int. Cl.[6] ..... B41J 2/325
[52] U.S. Cl. ..... 342/188
[58] Field of Search ..... 346/76 PH; 400/120

[56] References Cited

U.S. PATENT DOCUMENTS 4,522,881 6/1985 Kobayashi et al. ..... 428/336
4,738,555 4/1988 Nagashima ..... 346/76 PH
5,006,502 4/1991 Fujimura et al. ..... 503/227

*Primary Examiner*—Benjamin R. Fuller
*Assistant Examiner*—Huan Tran
*Attorney, Agent, or Firm*—Parkhurst, Wendel & Rossi

[57] ABSTRACT

An image forming method using a thermal transfer, wherein a dye-receptive layer on a transfer film is transferred to a print sheet and then dye layers on a dye transfer film are superposed on the dye-receptive layer and subjected to an image forming operation of a thermal head so that an image is transferred to the dye-receptive layer. In order to transfer the dye-receptive layer to the print sheet uniformly to enable subsequent formation of an excellent dye image, the quantity of thermal energy being applied by the thermal head to the transfer film is decreased with elapse of time. This principle can also be used for transferring a protective layer to the print sheet on which a dye image has been formed.

46 Claims, 6 Drawing Sheets

IMAGE FORMING METHOD USING THERMAL TRANSFER

BACKGROUND OF THE INVENTION

The present invention relates to an image forming method using heat or thermal transfer and more particularly to an image forming method using a thermal transfer, wherein a dye-receptive layer or an image protective layer is transferred uniformly so that an excellent image can be formed.

Heretofore, various thermal transfer methods have become known. Among these, a method uses a heat or thermal transfer film comprising a sublimable dye layer carried as a recording substance on a base film or substrate such as a paper or a plastic film. According to this method, full-color images are transferred from the thermal transfer film onto a dye-receptive layer of a print sheet. In the practice of this method, a thermal head of a printer is used as a heating means. Thus a large number of color dots of three or four colors are transferred onto the dye-receptive layer of the print sheet by heating for an extremely short time. By these multicolor dots, a full-color image of an original is reproduced on the print sheet.

According to the above described method, the material of the print sheet has been limited to materials such as a plastic sheet possessing dyeability or a paper provided beforehand with a dye-receptive layer. That is, images could not be formed directly on readily available materials such as ordinary paper. This has been a problem. It is possible, of course, to form an image on ordinary paper if a dye-receptive layer is previously formed thereon. In general, however, such a procedure entails high cost and is difficult to apply to materials that are generally ready made such as postcards, memo sheets, letter-papers, and papers for report writing.

Various methods have been proposed to solve these problems. One such method aims to form in a simple manner a dye-receptive layer on only necessary portions for forming images on a print sheet of a ready-made material such as ordinary paper by using a receptive layer transfer film, as disclosed in U.S. Pat. No. 5,006,502. Further, as disclosed in U.S. Pat. No. 4,522,881, in order to improve the durability of a dyed image formed in the above described manner, the depositing of a protective layer transfer film comprising a transparent resin on the dyed image surface has been proposed.

A method intended to simplify the operational procedure comprises the following steps. On the surface of a long substrate or base film, dye layers respectively of yellow, cyan, magenta, and, if necessary, black are formed in sequence. On the same surface of the substrate film, a transferable dye-receptive layer and/or a transferable protective layer are/is provided. First, the dye-receptive layer is transferred onto a print sheet. Then, dyes of the respective colors are transferred onto the dye-receptive layer thereby to form a full-color image. When required, a protective layer is transferred onto the image surface.

In each of the above described methods, a dye-receptive layer is transferred by means of a thermal head. In the case where the print sheet is a sheet lacking surface smoothness such as an ordinary paper sheet or a postcard, the adhesion of the dye-receptive layer with the print sheet becomes a problem, which gives rise to a further problem in that a uniform receptive layer is not transferred.

This problem can be solved by increasing the thermal energy imparted to the print sheet and the dye-receptive layer. However, if transferring of the dye-receptive layer under this condition of high thermal energy is continued, heat will accumulate within the printer and, as a consequence, will give rise to various problems. One such problem is the matting (roughening) of the surface of the dye-receptive layer. Another problem is the fusing of the heat-resistant layer or its substrate sheet to the thermal head, whereby the smooth feeding of the thermal transfer film is obstructed or the transfer film is torn. Still another problem is apt to occur in the case where a releasing layer or parting layer has been formed between the dye-receptive layer and the substrate film of the transfer film. In this case, the parting layer may melt to cause defective separation of the dye-receptive layer, which will then be prevented from being completely transferred. In consideration of the accumulation of heat within the printer as mentioned above, the imparting of the thermal energy at a low rate from the beginning may appear to be a solution. However, if this measure is taken, defective transfer will occur during the initial period of the transfer, whereby there will be much untransferred parts or incompletely transferred portions. Another problem is the possibility of transfer of the dye-receptive layer with uneven edges.

The above described problems occur also in the case where a protective layer is transferred from a protective layer thermal transfer sheet onto the image surface formed on the dye-receptive layer.

SUMMARY OF THE INVENTION

It is an object of the present invention to provide an image forming method using thermal transfer, in which the above described problems of the prior art are solved, and the dye-receptive layer and/or the protective layer are/is uniformly transferred, whereby excellent sublimable-dye images are formed.

The above stated object, and other objects, have been achieved by the present invention. According to this invention, briefly summarized, there is provided an image forming method using thermal transfer, including the step of transferring a dye-receptive layer and/or a protective layer from a transfer film carrying the layer or layers to a print sheet by applying a thermal energy thereto, wherein the quantity of the thermal energy being applied to the transfer film is varied with elapse of time or with location.

DESCRIPTION OF THE PREFERRED EMBODIMENTS

The image-forming method of the present invention will now be described in greater detail with reference to preferred modes of practice thereof as indicated in the accompanying drawings.

Figure 1:
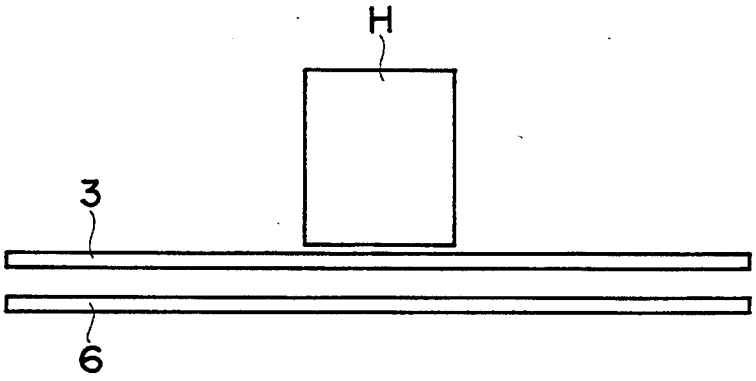
FIG. 1 is a schematic view showing the principle of thermal transfer.

In the method of this invention, a dye-receptive layer is transferred as indicated in FIG. 1 from a dye-receptive layer transfer film 3 onto a specific region of a print sheet 6 by means of a thermal head H as is known in the art. According to this invention, various methods shown in FIGS. 2*a* through 2*e* may be used.

Figure 2A:
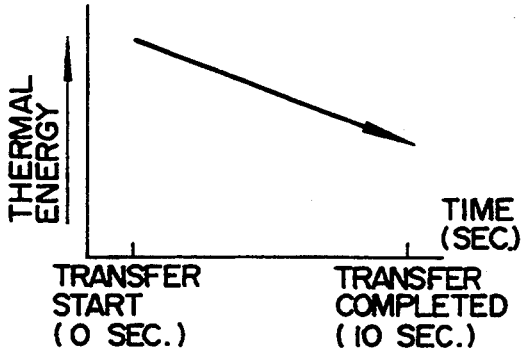
FIGS. 2*a* through 2*e* are graphs for a description of various examples of the image forming method of this invention.

In the mode of practice shown in FIG. 2*a*, the thermal energy supplied from the thermal head H at the time of starting of the transfer of the dye-receptive layer is brought to an ample level, and, in correspondence with the heat accumulated within the printer, the thermal energy being supplied to the thermal head is gradually reduced, for example, linearly as shown. The thermal head is operated for ten seconds in this mode of practice.

Figure 2B:
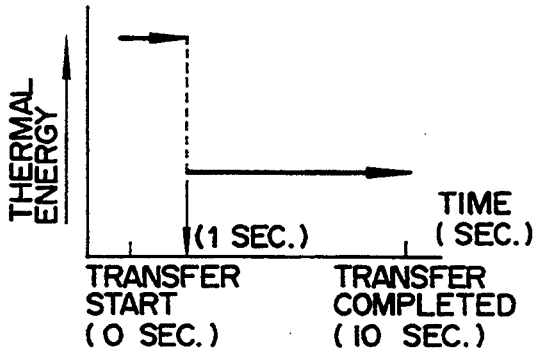

In the mode of practice shown in FIG. 2*b*, similarly as in the above method, ample thermal energy is supplied for the thermal head during a certain time (one second, for example) from the instant of starting of transfer (i.e., the time for the printer to warm up), and thereafter the level of the heat energy supplied is lowered and maintained constant as shown.

Figure 2C:
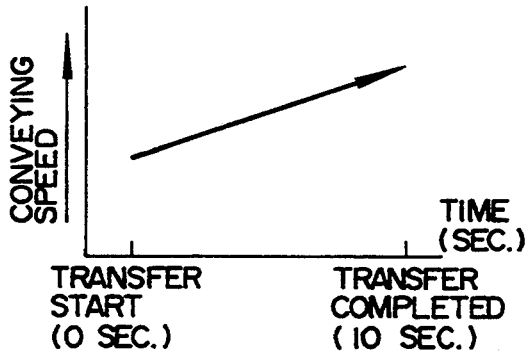

In the mode of practice shown in FIG. 2*c*, during the transfer of the dye-receptive layer, the print sheet and the receptive layer transfer sheet are conveyed at a speed corresponding to the rotational speed of the platen. In this case, however, the conveying speed of the printing sheet and the transfer film is gradually increased, for example, linearly, the heat energy being supplied at a constant rate from the thermal head at this time.

Figure 2D:
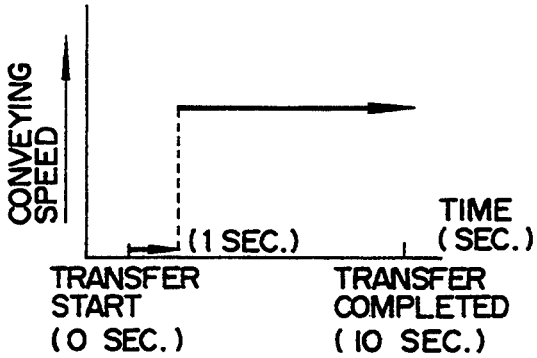

In the mode of practice shown in FIG. 2*d*, similarly as in the mode of FIG. 2*c*, the heat energy supply rate is kept constant, and, at the time of starting of transfer, the conveying speed of the print sheet and transfer film is kept at zero or at a low value and is increased to the normal value after the printer has warmed up. A somewhat low level of the thermal energy supplied from the thermal head is sufficient because the accumulated heat within the printer is being considered in this case.

Figure 2E:
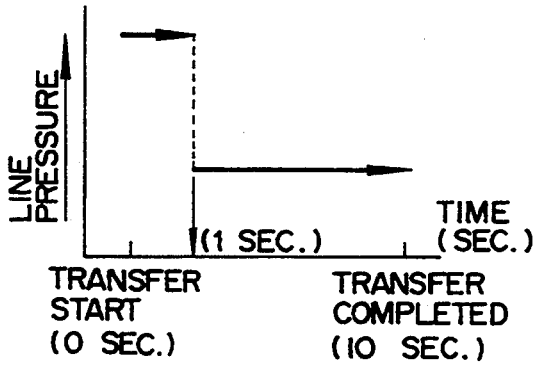

In the mode of practice of FIG. 2*e*, at the time of starting of the transfer of the dye-receptive layer, the contact pressure (line pressure) of the thermal head against the transfer film is kept at a high value for a certain time for example, one second (until heat accumulates in the printer), and is maintained at a lower value after heat has accumulated in the printer.

Figure 3:
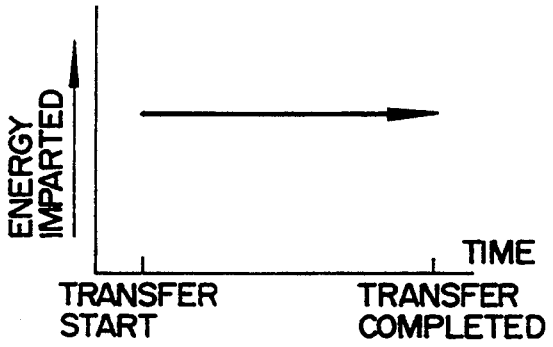
FIG. 3 is a graph for a description of a known method.

FIG. 3 is a graph indicating the state of supply of thermal energy according to the prior art. This mode of thermal energy supply gives rise to various problems as described hereinbefore.

The method of this invention has been described above with respect to case of transfer of the dye-receptive layer. The transfer of a protective layer is carried out in exactly the same manner in the case of transfer of the protective layer.

In the practice of the method of the present invention as described above, the quantitative rate of imparting of thermal energy by the thermal head to the dye-receptive layer (or the protective layer) and the transfer sheet is kept high initially and thereafter is lowered essentially with the elapse of time. As long as this essential mode of thermal energy supply is observed, quantitative fluctuations of thermal energy imparted intermediately are inconsequential.

The principal examples of the print sheet 2 useable in the method of this invention are various kinds of paper such as ordinary paper, paper for PPC, thermal transfer paper, high-quality paper, art paper, coated paper, cast coated paper, and Kent paper. Furthermore, plastic sheets, synthetic papers, and laminated sheets of these materials are also useable. In addition, various sheets having dye-receptive layers formed beforehand thereon are also useable.

Figure 4:
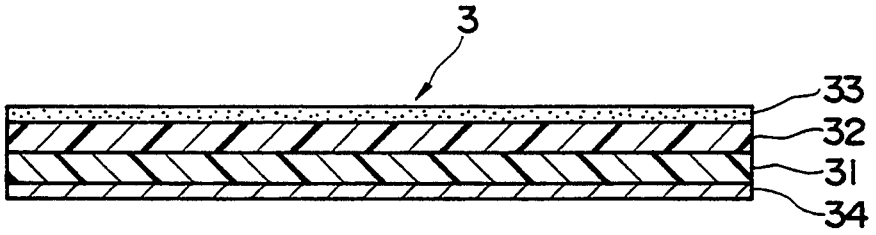
FIG. 4 is a sectional view of a receptive layer transfer film.

An example of a transfer film 3 suitable for use in the practice of the present invention is shown as a sectional view in FIG. 4. As shown, this film 3 has a substrate or base film 31 of a material such as a polyester film or a polyimide film. On one surface of this base film 31, a dye-receptive layer 32 of a resin which is dyeable with sublimable dyes, such as polyester resin, epoxy resin, vinyl chloride, vinyl acetate, vinyl chloride-vinyl acetate copolymer, and styrene, is formed. On top of this dyeable layer 32, an adhesive layer 33 is formed. This adhesive layer 33 comprises an adhesive material such as a vinyl chloride-vinyl acetate copolymer, an acrylic resin, a polyamide resin, a polyester resin, a polyurethane resin, or an epoxy resin. The adhesive layer 33 is thus provided, in accordance with necessity, for the purpose of imparting cohesiveness and like properties. Furthermore, to this adhesive layer 33, a filler, a foaming agent, or the like may be added for the purpose of imparting properties such as cushioning property, opacity, whiteness, and easiness for cutting. In addition, a heat-resistant lubricious layer 34 can be formed on the opposite surface of the base film 31 if necessary.

Figure 7:
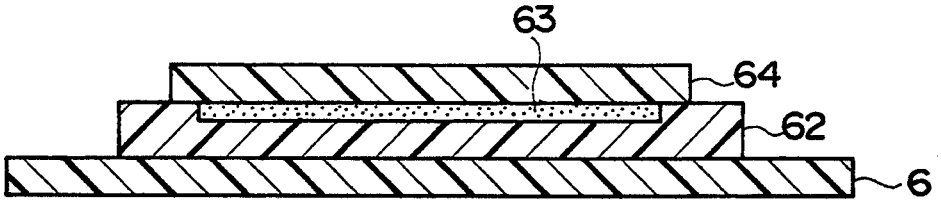
FIG. 7 is a sectional view indicating an image-forming method and a print sheet on which an image is formed.

The receptive layer transfer film 3 of the above described composition is superposed on a surface of a print sheet 6 as shown in FIG. 1. Then, according to the method of this invention, heat and pressure are applied with a thermal head from behind. As indicated in FIG. 7, by this process, a dye-receptive layer 62 with sharp or cleanly edges can be transferred onto only the necessary region of the print sheet 6. The receptive layer transfer film itself, is described in detail in the U.S. patents mentioned hereinbefore. While the dye-receptive layer 62 formed by the above described method may be of any thickness, it is generally of a thickness in the range of 1 to 30 μm.

Figure 5:
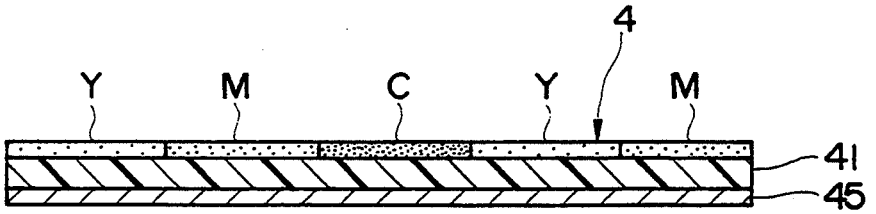
FIG. 5 is a sectional view of a thermal dye transfer film.

According to the image forming method of the present invention, after the dye-receptive layer has been transferred by the above described process, a dye image is formed by a thermal transfer method on the dye-receptive layer. A sublimable dye transfer film used in this case is illustrated in FIG. 5. As shown, this film has a base film 41. On one surface of this base film 41, sublimable dyes of yellow Y, magenta M, cyan C, and, if necessary, black (not shown) are carried by means of a binder. If necessary, a heat-resistant lubricious layer 45 is provided on the back side. Then, by printing with the thermal head of a printer in the known manner, a full-color image 63 of freely selectable shade and gradation is formed within the dye-receptive layer 62 as shown in FIG. 7. Such a sublimable transfer film, itself, is known in the prior art and can be used in the method of this invention.

Figure 6:
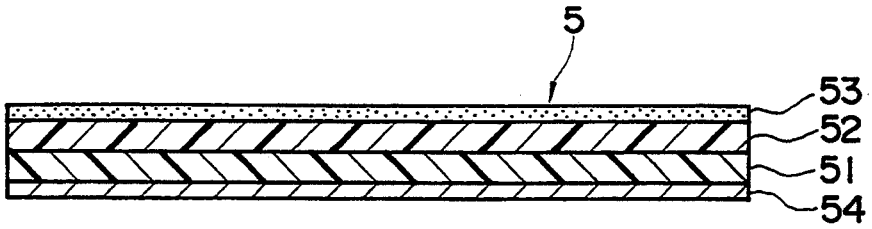
FIG. 6 is a sectional view of a protective layer transfer film.

An example of a protective layer transfer film 5 suitable for use in the practice of this invention is shown in sectional view of FIG. 6. This film 5 has a base film 51 of a material such as a polyester film or a polyimide film. On one surface of this base film 51, a protective layer 52 of a material having excellent transparency and durability such as a polyester resin, an epoxy resin, an acrylic resin, and a vinyl chloride-vinyl acetate copolymer is formed. On top of this protective layer 52, an adhesive layer 53 of an adhesive material such as a vinyl chloride-vinyl acetate copolymer, an acrylic resin, or a polyamide resin is formed if necessary. On the opposite surface of the base film 51, a heat-resistant lubricious layer 54 is formed according to necessity.

This protective layer transfer film 5 is superposed on the image 63 formed on the print sheet 6. Then, by the method of this invention, a protective layer 64 can be transferred as indicated in FIG. 7 on only a necessary region of the image by means of a thermal head contacting the protective layer transfer film 5 from behind. By transferring this protective layer 64 in a manner such that it is somewhat larger than the image surface as indicated in FIG. 7, the durability of the image can be further improved. The above described protective transfer film 15 per se, is described in detail in U.S. Pat. No. 4,522,881.

Instead of the above described protective layer 64, a protective laminate sheet of materials such as polyester film and vinyl chloride resin film may be bonded to the image surface, with an adhesive layer interposed therebetween if necessary, by means of a heat roll or a heat press. The above described protective layer and laminate sheet may be made of materials having a screening effect relative to,ultraviolet rays.

Figure 8:
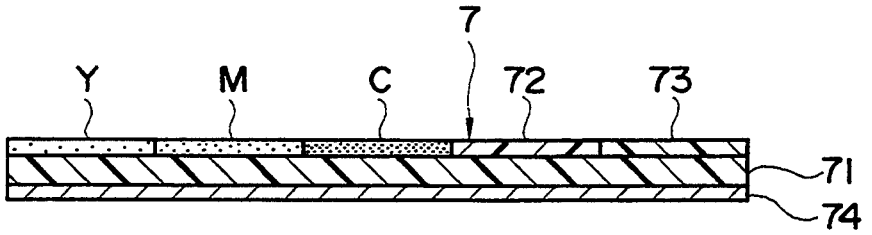
FIG. 8 is sectional view of a composite transfer film.

In the practice of the present invention, a composite transfer film 7 as shown in sectional view in FIG. 8 may be used to carry out image forming as described above. As shown in FIG. 8, this composite transfer film 7 has a base film 71, on a surface of which at least two kinds of layers from among the above described dye-receptive layer 72, the dye layers Y, M, and C, and the protective layer 73 are provided in sequence.

In order to indicate more fully the nature and details of the present invention, the following specific examples of practice thereof are presented. Throughout these examples, quantities expressed in "parts" and "percent" are by weight unless specified otherwise.

EXAMPLE 1

A heat-resistant lubricious layer was formed on the back surface of a polyethylene terephthalate film (#25, product of Toray Kabushiki Kaisha, Japan). On the front surface of this film, a coating liquid for forming a dye-receptive layer of the composition specified below was applied by means of a bar coater to form a first coat of 5.0 g/m$^2$ (in dried state). Further, over this first coat, a coating liquid for forming an adhesive layer of the composition specified below was similarly applied to form a second coat of 2.0 g/m$^2$ (in dried state) which was dried. Thus a dye-receptive layer transfer film was obtained.

| Composition of coating liquid for dye-receptive layer: | |
|---|---|
| vinyl chloride-vinyl acetate copolymer (VYHD, prod. of Union Carbide Corporation) | 100 parts |
| epoxy modified silicone (KF-393, prod. of Shinetsu Kagaku Kogyo Kabushiki Kaisha, Japan) | 3 parts |
| amino modified silicone (KS-343, prod. of Shinetsu Kagaku Kogyo K.K.) | 3 parts |
| methylethyl ketone/toluene (weight ratio 1/1) | 400 parts |
| Composition of coating liquid for adhesive layer: | |
| polymethylmethacrylate (BR-106, prod. of Mitsubishi Rayon Kabushiki Kaisha, Japan) | 100 parts |
| methylethyl ketone/toluene (weight ratio 1/1) | 500 parts |

Next, on a polyester film similar to that mentioned hereinbefore, yellow, magenta, and cyan inks as specified below were applied by repeated coating and drying to form sublimable dye layers of 30-cm width in sequence, each in a coating quantity of approximately 3 g/m$^2$ (in dried state). Thus a sublimable dye transfer film was obtained.

| Yellow ink | |
|---|---|
| dispersed dye (Macrolex Yellow 6G, prod. of Bayer AG., C.I. Disperse Yellow 201) | 5.5 parts |
| polyvinyl butyral resin (S-Lec BX-1, prod. of Sekisui Kagaku Kogyo Kabushiki Kaisha, Japan) | 4.5 parts |
| methylethyl ketone/toluene (weight ratio 1/1) | 89.0 parts |

Magenta ink

Similar to yellow ink except for use of magenta dispersed dye (C.I. Disperse Red 60) for the dye.

Cyan ink

Similar to yellow ink except for use of cyan dispersed dye (C.I. Solvent Blue 63) for the dye.

Next, on the surface of a similar polyester film, an ink for forming a protective layer of the composition specified below was applied by a gravure coating method to form a coating of a quantity of 5 g/m$^2$ (solid content basis). Further, over this coat, a coating liquid for forming an adhesive layer was similarly applied and dried to form an adhesive coat in a quantity of 2 g/m$^2$ (solid content basis). Thus, a protective layer transfer film was obtained.

| Composition of coating liquid for protective layer: | |
|---|---|
| Polymethylmethacrylate | 100 parts |

-continued

| | |
|---|---|
| (BR-85, prod. of Mitsubishi Rayon Kabushiki Kaisha, Japan) | |
| methylethyl ketone/toluene (weight ratio 1/1) | 500 parts |
| Composition of coating liquid for adhesive layer: | |
| vinyl chloride-vinyl acetate copolymer resin (1000AS, prod. of Denki Kagaku Kogyo Kabushiki Kaisha, Japan) | 100 parts |
| methylethyl ketone/toluene (weight ratio 1/1) | 500 parts |

EXAMPLES 2 TO 6 AND COMPARISON EXAMPLES 1 AND 2

For each example, an official postcard issued by the Post Office was inserted into a video printer. Then, under the printing condition set forth in the following Table 1, a dye-receptive layer was first transferred onto a specific position of each postcard with the aforedescribed dye-receptive layer transfer film. Next, with a dye transfer film, a full-color scenic picture was formed over the entire surface of the dye-receptive layer. Further, under the printing condition of Table 1, a protective layer was transferred onto the image surface by using a protective layer transfer film, whereupon a beautiful and, moreover, a highly durable image was obtained. The results relating to the dye-receptive layer and the protective layer thus transferred are shown in the following Table 2.

TABLE 1

Printing condition
Both receptive layer transfer and protective layer transfer are the same, printing time being 10 seconds in all cases

| | | |
|---|---|---|
| Example 2 | Energy at start of transfer: | 90 mJ/mm$^2$ |
| | Energy at completion of trasnfer: | 60 mJ/mm$^2$ |
| | Conveying speed: | 10 mm/sec (constant) |
| | Line pressure: | 2 kg weight/cm (constant) (Ref. FIG. 2a) |
| Example 3 | Energy from start of transfer to 1 sec. thereafter: | 90 mJ/mm$^2$ (constant) |
| | Energy thereafter: | 70 mJ/mm$^2$ (constant) |
| | Conveying speed: | 10 mm/sec (constant) |
| | Line pressure: | 2 kg weight/cm (constant) (Ref. FIG. 2b) |
| Example 4 | Conveying speed at start of transfer: | 5 mm/sec |
| | Conveying speed at completion of trasnfer: | 10 mm/sec |
| | Transfer energy: | 60 mJ/mm$^2$ (constant) |
| | Line pressure: | 2 kg weight (constant) (Ref. FIG. 2c) |
| Example 5 | Conveying speed from start of transfer to 1 sec. thereafter: | 0 mm/sec (constant) |
| | Conveying speed thereafter to completion of transfer: | 10 mm/sec (constant) |
| | Transfer energy: | 60 mJ/mm$^2$ (constant) |
| | Line pressure: | 2 kg weight (constant) (Ref. FIG. 2d) |
| Example 6 | Line pressure from start of transfer to 1 sec thereafter: | 4 kg weight (constant) |
| | Line pressure thereafter to completion of transfer: | 2 kg weight (constant) |
| | Transfer energy: | 60 mJ/mm$^2$ (constant) |
| | Conveying speed: | 10 mm/sec (constant) |

TABLE 1-continued

Printing condition
Both receptive layer transfer and protective layer transfer are the same, printing time being 10 seconds in all cases

| | | |
|---|---|---|
| | | (Ref. FIG. 2e) |
| Comparison Example 1 | Transfer energy: | 80 mJ/mm$^2$ (constant) |
| | Conveying speed: | 10 mm/sec (constant) |
| | Line pressure: | 2 kg weight (constant) (Ref. FIG. 3) |
| Comparison Example 2 | Transfer energy: | 60 mJ/mm$^2$ (constant) |
| | Conveying speed: | 15 mm/sec (constant) |
| | Line pressure: | 1.5 kg weight (constant) (Ref. FIG. 3) |

TABLE 2

| | Sharpness of transferred layer of portion at start of transfer | Fusion with film |
|---|---|---|
| Example 2 | good | none |
| Example 3 | good | none |
| Example 4 | good | none |
| Example 5 | good | none |
| Example 6 | good | none |
| Comparison Example 1 | good | poor peeling; tending to fuse |
| Comparison Example 2 | Periphery ragged and adhesiveness deficient | good |

EXAMPLE 7

A heat-resistant lubricious layer was formed on the back surface of a polyethylene terephthalate film (#25, prod. of Toray Kabushiki Kaisha, Japan). On the front surface of this film, the aforedescribed coating liquid for forming a dye-receptive layer was applied initially by means of a bar coater to form layers in a coating quantity of 5.0 g/m$^2$ (dried state) with a width of 30 cm at spacing intervals of 120 cm. Further, over these layers thus applied, the aforedescribed coating liquid for forming an adhesive layer was applied similarly in a coating quantity of 2.0 g/m$^2$ (dried state) and dried to form dye-receptive layers.

Next, on each uncoated region of the polyester film, the aforedescribed yellow, magenta, and cyan inks were applied in a coating quantity of approximately 3 g/m$^2$ (dried state) to form respective coated areas in sequence, each of a width of 30 cm at intervals of 30 cm. This coating process was repeated for all uncoated regions of the polyester film, and the inks thus coated were dried. Thus sublimable dye layers of three colors were formed.

Then, on the uncoated surface of the same polyester film, the ink for forming a protective layer of the aforedescribed composition was applied in a coating quantity of 5 g/m$^2$ (solid content basis) by a gravure coating method to form layers of a width of 30 cm at intervals of 120 cm, which were then dried. Over these protective layers, the adhesive layer forming ink of the aforedescribed specification was applied to form a coat in a coating quantity of 1 g/m$^2$ (solid content basis). This coat was dried thereby to form a protective layer. Thus, a composite transfer film on which receptive layers, dye layers, and protective layers were formed in sequence was prepared.

With the use of the above described composite transfer film, an image was formed similarly as in Example 1 on an ABS resin sheet (188 μm) for cards as a print sheet, whereupon a similar effective result was obtained.

According to the present invention as described above, the quantitative rate at which thermal energy is imparted to the dye-receptive layer transfer film and/or a protective layer transfer is essentially decreased with the elapse of time. By this technique, a uniform receptive layer and/or a protective layer can be transferred even when the printer is operated over a long time.

Figure 9A:
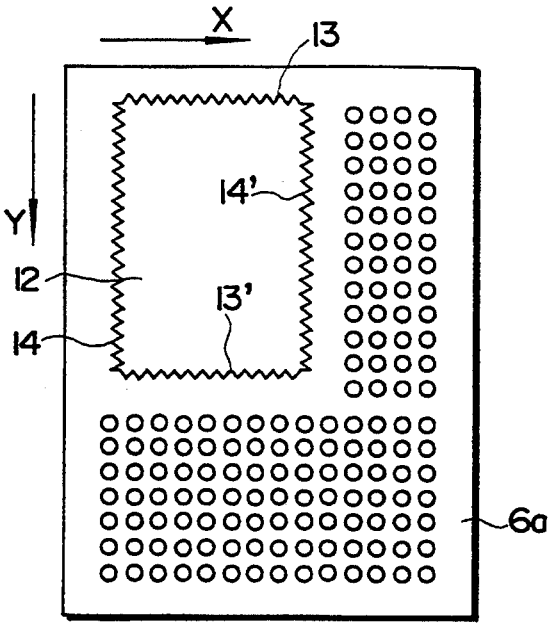
FIGS. 9*a* and 9*b* are views for an explanation of a problem occurring when an image is to be transferred to a dye-receptive layer on a print sheet.
Figure 9B:
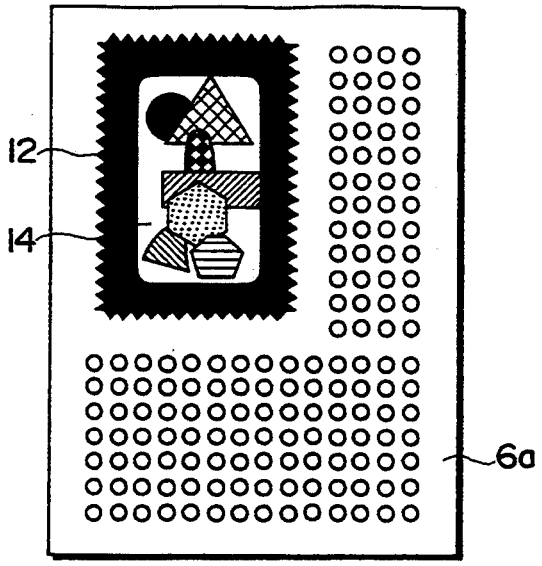

When the dye-receptive layer is transferred to the entire surface of the print sheet by using a thermal head, a heat roll, or a heat press, no problem occurs. However, when the dye-receptive layer is transferred, as shown in FIG. 9*a*, to a part 12 of a print sheet 6*a* such as a postcard made of ordinary paper as a pattern by a thermal head, the edges of the dye-receptive layer are not sharply cut, but become ragged or waved. Since the dye-receptive layer having ragged edges is normally white or transparent, the raggedness is not recognizable. However, when the image is transferred to, or formed on the entire surface of the dye-receptive layer of the print sheet, the irregularities of the edges become conspicuous as shown in FIG. 9*b*. When a protective layer is transferred to a print sheet, the above problem also takes place.

In accordance with a method described below, the above mentioned problem can be solved.

Figure 10A:
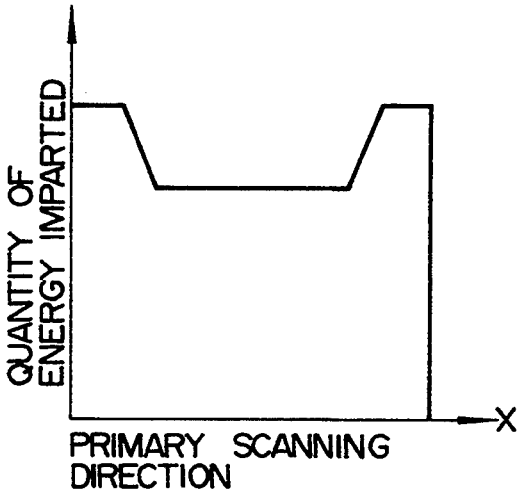
FIGS. 10*a* and 10*b* are graphs showing the method for solving the problem indicated in FIGS. 9*a* and 9*b;*
Figure 10B:
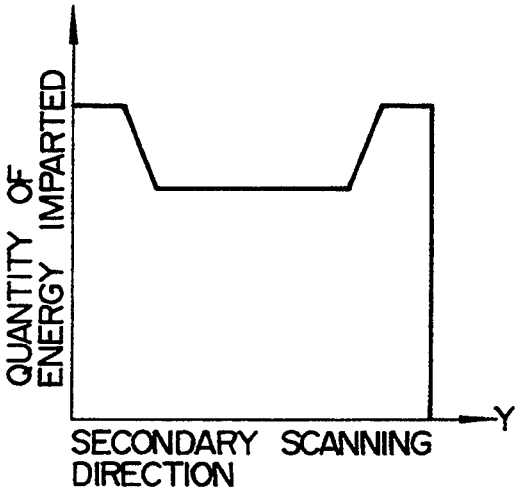

As schematically shown in FIG. 9*a*, the thermal head is moved for scanning in primary and secondary scanning directions X and Y in respect of a particular transfer region 12 of a print sheet 6*a* and then a dye-receptive layer is transferred from a receptive layer transfer film to the print sheet 6*a* in such a manner that the quantity of thermal energy per unit area applied to the vicinity of edge portions 13, 13', 14, and 14' of the transfer region 12 is greater than that for the remaining region in both the primary scanning direction x and the secondary scanning direction Y, as schematically shown in FIGS. 10*a* and 10*b*. Thus, the edges of the dye-receptive layer being transferred are sharply-formed in a desired shape. On the other hand when thermal energy is uniformly applied to the entire surface of the transfer region in the conventional manner, the edges of the transfer region 12 become irregular, as shown in FIG. 9*b*. When high energy is applied to the entire surface of the transfer region, such a problem will of course not occur. However, a number of disadvantages with respect to energy efficiency, service life of the thermal head, and fusion of the transfer film to the thermal head will occur.

For increasing the quantity of thermal energy applied to the edge portions 13, 13', 14, and 14''' of the transfer region 12, a line-type thermal head may be used and moved in the secondary scanning direction Y in FIG. 9*a*, while the quantity of thermal energy applied to both end portions of the thermal head is increased. Thus, the quantity of thermal energy to be applied to the edge portions 14 and 14' are increased. In addition, at the edge portions 13 and 13', the moving speed of the thermal head is made smaller than in the other portion so that the quantity of thermal energy to be applied thereto is increased in the vicinity of the edges 13 and 13'. FIGS. 10*a* and 10*b* show the quantities of thermal energy applied to the regions in the primary scanning direction X and the secondary scanning direction Y, respectively. When a serial-type thermal head is used, the quantities of thermal energy to be applied to the edge portions may be simply increased. The quantity of the thermal energy necessary for transferring the dye-receptive layer must be determined in consideration of various conditions of the materials of the print sheet, dye-receptive layer, its substrate film and so forth. Generally, it has been found that the quantity of thermal energy is in a range from 60 to 150 mJ/mm$^2$. It is preferable that the quantity of the thermal energy to be applied to the edge portions of the transfer region be approximately 105 to 150% of the above quantity. The quantity of thermal energy applied is changed preferably by changing the width of voltage pulses imparted to the thermal head. One cycle of the pulses may be from several to several tens milliseconds.

The above mentioned method may also be used for a protective layer transfer film instead of the dye-receptive layer transfer film. Some examples of the above method will be shown below.

EXAMPLE 8

A postcard issued by the Post Office was loaded into a test printer and, as shown in FIG. 9*a*, a dye-receptive layer was transferred to a predetermined position of the postcard by using the dye-receptive layer transfer film mentioned before. The quantity of thermal energy applied to the printer corresponding to both ends of the transfer region of the printer was 120% of that applied to the other region where the quantity of energy being applied was 90 mJ/mm$^2$). The scanning speeds at the transfer start position and the transfer completion position in the scanning direction were 20% lower than the speed in the other region. Thereafter, a full color scenic image was formed on the entire surface of the dye-receptive layer on the print sheet. This image was clear and had a high resolution. In addition, the edge portions of the image were linear and sharp. On the other hand, when transfer energy is uniformly applied to the entire surface of the dye-receptive layer (the quantity of energy being applied was 90 mJ/mm$^2$), the edges of both the dye-receptive layer transferred and those of the image formed were ragged and unsightly.

Moreover, when a protective layer having the same size as the image was transferred to the image surface of the print sheet in the same condition as above by using a protective layer transfer film, the edges of the protective layer transferred were matched with those of the dye-receptive layer and the image formed, and the image was sharp. On the other hand, when transfer energy was uniformly applied to the entire surface of the protective layer (the quantity of energy applied was 90 mJ/mm$^2$), the edges of the protective layer transferred to the image surface were ragged and the image was unsightly.

EXAMPLE 9

The above mentioned coating liquid for the dye-receptive layer was applied by means of a bar coater in a width of 30 cm at intervals of 120 cm on the front surface of a polyethylene terephthalate film (#25, product of Toray K.K., Japan) whose rear side had a heat-resistant lubricious layer, the coating solution being applied at a rate of 5.0 g/m$^2$ (in dried state). Thereafter, the above mentioned coating solution for adhesive layer was applied by a bar coater on the surface of the film at a rate of 2.0 g/m$^2$ (in dried state). Thereafter, the film was dried and thus a dye-receptive layer was formed.

Next, the yellow ink, magenta ink, and cyan ink referred to before were applied in sequence to a polyester film in a width of 30 cm at intervals of 30 cm and at a rate of approximately 3 g/m$^2$ (in dried state). Thereafter, the film was dried and sublimable dye layers of three color were formed.

Then, a coating liquid for protective layer with the composition mentioned before was applied in a width of 30 cm at intervals of 120 cm and at a rate of 5 g/cm$^2$ (in dried state) to the same polyester film by a gravure coating method and then the liquid was dried. Thereafter, the above mentioned liquid for adhesive layer was applied to the film at a rate of 1 g/m$^2$ (solid content basis). Thereafter, the liquid was dried and a protective layer was formed. In other words, a composite transfer film having thereon dye-receptive layers, sublimable dye layers and protective layers in sequence was formed.

When an image was formed on a card-type ABS resin sheet as a print sheet by using the above-mentioned composite transfer film in the same manner as the example 8, the same effect as the example 8 could be obtained.

In accordance with a method described below, it is also possible to prevent the dye-receptive layer to be transferred to the print sheet 6a from becoming ragged or waved.

Figure 11:
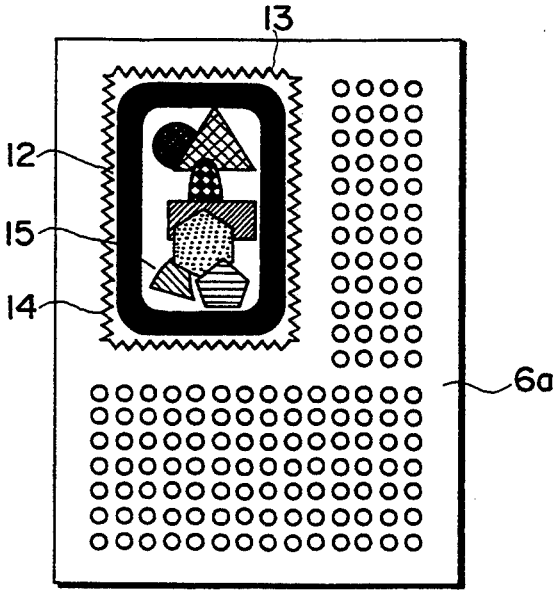
FIG. 11 is a view for a description of a method for preventing irregularities along the edges of an image formed in a dye-receptive layer on a print sheet.

As shown in FIG. 11, when an image 15 is formed in such a way that the dye-receptive layer of a transfer region 12 is not used for forming the image along the outer edges, the problem mentioned before will not occur. Since the dye-receptive layer in the region in which the image is not formed is white or transparent like the print sheet 6a, irregularity of the edge portion 13 is not so conspicuous. Of course, it is desirable to form the image 15 closer to the edges 13 and 14 than in the example shown in the figure. It is further desirable to form the image 15 to an extent one to several printing dots inner than the edges 13 and 14 of the region 12 of the dye-receptive layer.

Figure 12:
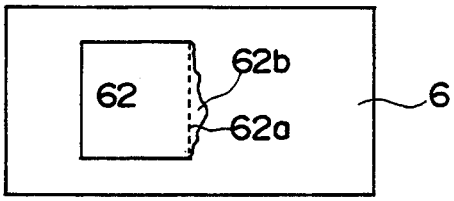
FIG. 12 is a view for a description of a problem occurring at an edge of a dye-receptive layer transferred to a print sheet.

When a dye-receptive layer 62 is transferred to a desired region on a print sheet by using a thermal head, as shown in FIG. 12 the trailing edge of the dye-receptive layer 62 designed to be straight tends to become ragged as represented by a dotted line 62a. This is because the thermal head which has operated to transfer the dye-receptive layer 62 of a particular width is not cooled immediately after it has been turned off. Thus, the dye-receptive layer is excessively transferred due to residual heat so that the trailing edge cannot be formed straight. When the area of the dye-receptive layer being transferred exceeds a predetermined region, the dye is also transferred to an unnecessary portion 62b surrounded by the dotted line and the ragged line. Thus, the image formed becomes unsightly.

The above mentioned problem also occurs in the case where the protective layer is transferred from the protective layer transfer film to the image surface formed in the dye-receptive layer on the print sheet.

Figure 13:
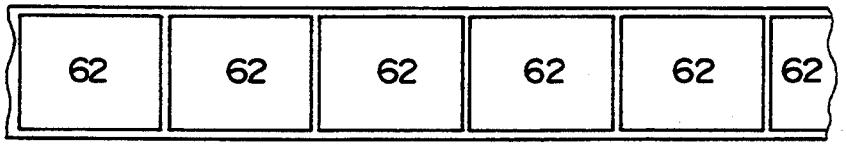
FIG. 13 is a view of a dye-receptive layer transfer film for solving the problem of FIG. 12.
Figure 14:
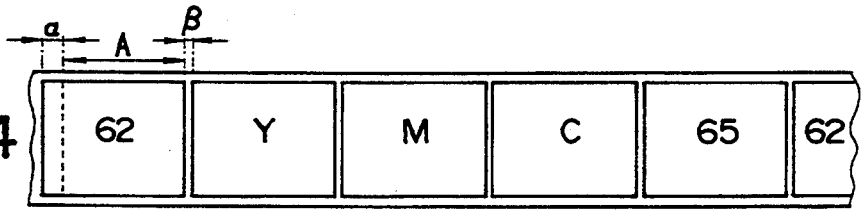
FIG. 14 is a view of another dye-receptive layer transfer film for solving the problem of FIG. 12.

To solve this problem, as shown in FIG. 13, image receiving layers 62 are disposed interruptedly in a manner isolated from each other via transverse slender portions. In FIG. 14, dye layers of yellow Y, magenta M, and cyan C and transferable protective layers 65 are provided in sequence with interruption, along with dye-receptive layers 62.

When an image is to be formed by using the composite thermal transfer film shown in FIG. 14, the composite transfer film and a print sheet (paper) 6 are loaded into a printer and then the dye-receptive layer is transferred to the print sheet. If the transfer region of the print sheet 6 has a width A (FIG. 15), the dye-receptive layer of the transfer film is caused to have a width $A+\alpha$ (where $\alpha>0$) (FIG. 14). The transfer start position of the dye-receptive layer is represented by a dotted line in FIG. 14. The heating end position by the thermal head is indicated by a righthand edge line of the dye-receptive layer 62 in FIG. 14. To satisfactorily transfer the righthand edge line in a linear shape, it is desirable that the heating end position of the thermal head be the position which slightly exceeds the righthand edge line by an amount of $\beta$. When the dye-receptive layer 62 is transferred to the print sheet 6 in the above described manner, the transfer end position of the dye-receptive layer 62' transferred will become linear.

Thereafter, a yellow image, a magenta image, and a cyan image are transferred to the dye-receptive layer 62' whereby a desired color image is formed. If necessary, a protective layer is transferred to the image surface. It is desirable that the transferring method for the protective layer conforms to that for the above mentioned dye-receptive layer.

EXAMPLE 10

Figure 15:
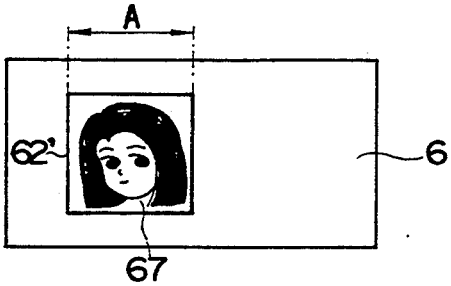
FIG. 15 is a view for a description of the width of a transfer area of a dye-receptive layer on the print sheet.

An A4 size ordinary paper sheet was loaded into a video printer. Next, a dye-receptive layer having a width of 25 cm was transferred to the paper sheet by a thermal head. When the dye-receptive layer 62 as shown in FIG. 14 was transferred, starting from the lefthand edge portion thereof (a comparison example), the trailing end of the dye-receptive layer transferred became irregular as shown in FIG. 12. On the other hand, when the dye-receptive layer was transferred from a position shown by the dotted line in FIG. 14 as the transfer start position, the edge was in a linear shape as shown in FIG. 15.

Next, an image of a human was formed on the entire surface of each of the above mentioned two types of dye-receptive layers by using dyes of yellow, magenta, and cyan in full color. Thereafter, a protective layer was transferred to the image surface. As a result, a clear and durable image was obtained. However, when the edge portions of the dye-receptive layers were not of linear shape, the image formed was unsightly.

What is claimed:

1. An image forming method using thermal transfer, comprising the steps of:

providing on a print sheet image forming regions each having a trailing edge;

providing dye-receptive layers interruptedly in sequence on an elongated substrate film, said layers having trailing edges, respectively, and a width greater than the respective image forming regions on the print sheet;

transferring said layers to said print sheet in such a manner that trailing edges of said image forming regions will coincide with the trailing edges of said layers transferred to the print sheet; and transferring an image to each of said dye-receptive layers from a sublimable dye transfer film so as to form said image in each of said dye-receptive layers.

2. The image forming method of claim 1, further comprising the steps of:

applying a quantity of thermal energy to each of said dye-receptive layers from a thermal head during said step of transferring said layers to said print sheet; and varying the quantity of thermal energy being applied with elapse of time.

3. An image forming method using thermal transfer, comprising the steps of:

providing on a print sheet image forming regions each having a trailing edge;

providing dye-receptive layers interruptedly in sequence on an elongated substrate film, said layers having trailing edges, respectively, and a width greater than the respective image forming regions on the print sheet;

transferring said layers to said print sheet in such a manner that trailing edges of said image forming regions will exceed the trailing edges of said layers transferred to the print sheet; and transferring an image to each of said dye-receptive layers from a sublimable dye transfer film so as to form said image in each of said dye-receptive layers.

4. The image forming method of claim 3, further comprising the steps of:

applying a quantity of thermal energy to each of said dye-receptive layers from a thermal head during said step of transferring said layers to said print sheet; and varying the quantity of thermal energy being applied with elapse of time.

5. An image forming method using thermal transfer, comprising the steps of:

providing a dye-receptive layer transfer film having a dye-receptive layer formed thereon;

superposing said transfer film on a print sheet;

applying a quantity of thermal energy to said transfer film from a thermal head to transfer said dye-receptive layer from said transfer film to said print sheet;

varying the quantity of thermal energy being applied with elapse of time; and transferring an image to said dye-receptive layer on said print sheet from a dye transfer film to form said image in the dye-receptive layer.

6. The image forming method of claim 5, wherein the quantity of thermal energy being applied to said transfer film is decreased with elapse of time.

7. The image forming method of claim 5, wherein the quantity of thermal energy is decreased by decreasing the quantity of thermal energy applied to the thermal head.

8. The image forming method of claim 6, further comprising the steps of:

moving said print sheet and said transfer film relative to the thermal head; and increasing the speed of moving said print sheet and said transfer film relative to the thermal head to thereby decrease the quantity of thermal energy applied to said transfer film.

9. The image forming method of claim 6, further comprising the steps of:

causing said print sheet and said transfer film to contact each other under contact pressure; and decreasing the contact pressure therebetween to thereby decrease the quantity of thermal energy applied to said transfer film.

10. The image forming method of claim 5, further comprising the steps of:

causing the thermal head and said print sheet to contact each other; and increasing a time period during which-the thermal head and said print sheet are in contact at a transfer start, thereby increasing the quantity of thermal energy applied to said transfer film at the transfer start.

11. The image forming method of claim 5, further comprising the steps of:

causing the thermal head and said print sheet to contact with each other; and increasing a time period during which the thermal head and said print sheet are in contact at a transfer completion, thereby increasing the quantity of thermal energy applied to said transfer film at the transfer completion.

12. The image forming method of claim 5, further comprising the step of:

carrying out said step of transferring an image to said dye-receptive layer to form said image in a smaller area than said dye-receptive layer.

13. The image forming method of claim 12, further comprising the step of:

forming said image in said dye-receptive layer to a size smaller, by one to several print dots, than a size of said dye-receptive layer.

14. An image forming method using thermal transfer, comprising the steps of:

providing a dye-receptive layer transfer film having a dye-receptive layer formed thereon;

superposing said transfer film on a print sheet;

applying a quantity of thermal energy to said transfer film from a thermal head to transfer said dye-receptive layer from said transfer film to said print sheet;

varying the quantity of thermal energy being applied with location; and transferring an image to said dye-receptive layer on said print sheet from a dye transfer film to form said image in the dye-receptive layer.

15. An image forming method using thermal transfer, comprising the steps of:

providing a dye-receptive layer transfer film having a dye-receptive layer formed thereon, said dye-receptive layer having a region with edge portions;

superposing said transfer film on a print sheet;

applying a quantity of thermal energy to said transfer film from a thermal head to transfer said dye-receptive layer from said transfer film to said print sheet;

causing the quantity of thermal energy being applied per unit area to be greater in said edge portions than in the remaining portion of said region; and transferring an image to said dye-receptive layer on said print sheet form a dye transfer film to form said image in the dye-receptive layer.

16. The image forming method of claim 15, wherein the thermal energy is applied to said edge portions by applying pulse voltage including a plurality of pulses to said thermal head and changing a width of each of the pulses.

17. The image forming method of claim 15, further comprising the step of:

carrying out said step of transferring an image to said dye-receptive layer to form said image in a smaller area than said dye-receptive layer.

18. The image forming method of claim 17, further comprising the step of:

forming said image in said dye-receptive layer to a size smaller, by one to several print dots, than a size of said dye-receptive layer.

19. An image forming method using thermal transfer, comprising the steps of:

providing dye-receptive layers intermittently in sequence on an elongated dye-receptive layer transfer film, each of said dye-receptive layers having a trailing edge;

providing, on an elongated print sheet, image forming regions each having a trailing edge, said dye-receptive layers having a width greater than corresponding image forming regions on said print sheet;

superposing said dye-receptive layer transfer film on said print sheet such that the trailing edges of said image forming regions coincide with, or overlap the trailing edges of corresponding dye-receptive layers formed on said transfer film;

transferring said dye-receptive layers from said dye-receptive layer transfer film to said print sheet by applying a quantity of thermal energy to said transfer film from a thermal head;

varying the quantity of thermal energy being applied with location; and transferring an image to said dye-receptive layer on said print sheet from a dye transfer film so as to form said image in the dye receptive layer.

20. An image forming method using thermal transfer, comprising the steps of:

providing a print sheet having a dye-receptive layer formed thereon;

providing a dye transfer film having a dye layer formed thereon;

transferring an image to said dye-receptive layer form said dye layer so as to form said image in the dye-receptive layer;

providing a protective layer transfer film having a protective layer formed thereon;

superposing said protective layer transfer film on said print sheet with said image formed in the dye-receptive layer thereof;

applying a quantity of thermal energy to said protective layer transfer film from a thermal head to transfer said protective layer onto said dye-receptive layer formed with said image; and varying the quantity of thermal energy being applied with elapse of time.

21. The image forming method of claim 20, wherein the quantity of thermal energy being applied to said protective layer transfer film is decreased with elapse of time.

22. The image forming method of claim 21, wherein the quantity of the thermal energy is decreased by decreasing the quantity of thermal energy applied to the thermal head.

23. The image forming method of claim 21, further comprising the steps of:

moving said print sheet and said protective layer transfer film relative to the thermal head; and increasing the speed of moving said print sheet and said protective layer transfer film relative to the thermal head, to decrease the quantity of thermal energy applied to said protective layer transfer film.

24. The image forming method of claim 21, further comprising the steps of:

contacting said print sheet and said protective layer transfer film with contact pressure; and decreasing said contact pressure to decrease the quantity of thermal energy applied to said protective layer transfer film.

25. An image forming method using thermal transfer, comprising the steps of:

providing a print sheet having a dye-receptive layer formed thereon;

providing a dye transfer film having a dye layer formed thereon;

transferring an image to said dye-receptive layer from said dye layer so as to form said image in the dye-receptive layer thereof;

applying a quantity of thermal energy to said protective layer transfer film from a thermal head to transfer said protective layer onto said dye-receptive layer formed with said image; and varying the quantity of thermal energy being applied with location.

26. An image forming method using thermal transfer, comprising the steps of:

providing a print sheet having a dye-receptive layer formed thereon, said dye-receptive layer having a region with edge portions;

providing a dye transfer film having a dye layer formed thereon;

transferring an image to said dye-receptive layer from said dye layer so as to form said image in the dye-receptive layer;

providing a protective layer transfer film having a protective layer formed thereon;

superposing said protective layer transfer film on said print sheet with said image formed in the dye-receptive layer thereof;

applying a quantity of thermal energy to said protective layer transfer film from a thermal,head to transfer said protective layer onto said dye-receptive layer formed with said image; and causing the quantity of thermal energy being applied per unit area to be greater in said edge portions than in the remaining portion of said region.

27. The image forming method of claim 26, wherein thermal energy is applied to said edge portions by applying pulse voltage including a plurality of pulses to said thermal head and changing a width of each of the pulses.

28. The image forming method of claim 26, further comprising the steps of:

causing said thermal head to contact with said print sheet; and increasing a time period during which the thermal head and the print sheet are in contact at each of a transfer start and a transfer completion, to increase the quantity of the thermal energy at each of said transfer start and said transfer completion.

29. The image forming method of claim 26, wherein said step of transferring an image to the dye-receptive layer from the dye layer is carried out to form the image in a smaller area than said dye-receptive layer.

30. An image forming method using thermal transfer, comprising the steps of:

providing on a print sheet an image receiving layer having a trailing edge;

transferring an image to said image receiving layer to form the image in said layer;

providing a protective layer on a protective layer transfer film, said protective layer having a trailing edge and a width greater than the image receiving layer on the print sheet; and transferring said protective layer to said print sheet in such a manner that the trailing edge of the protective layer overlaps the trailing edge of said image receiving layer on the print sheet.

31. The image forming method of claim 30, further comprising the step of:

applying thermal energy to said protective layer transfer film from a thermal head to carry out said transferring step, in such a manner that the thermal energy will reach an area beyond said trailing edge of the protective layer.

32. A method of producing a sheet with a dye-receptive layer, comprising the steps of:

providing a dye-receptive layer transfer film having a dye-receptive layer formed thereon;

superposing said transfer film on a print sheet;

applying a quantity of thermal energy to said transfer film from a thermal head to transfer said dye-receptive layer from said transfer film to said print sheet; and varying the quantity of thermal energy being applied with elapse of time.

33. The method of claim 32, wherein the quantity of the thermal energy being applied to said transfer film is decreased with elapse of time.

34. The method of claim 33, wherein the quantity of thermal energy is decreased by decreasing the quantity of thermal energy applied to the thermal head.

35. The method of claim 33, further comprising the steps of:

moving said print sheet and said transfer film relative to the thermal head; and increasing the speed of moving said print sheet and said transfer film to thereby decrease the quantity of thermal energy applied to said transfer film.

36. The method of claim 33, further comprising the steps of:

causing said print sheet and said transfer film to contact under contact pressure; and decreasing the contact pressure to thereby decrease the quantity of thermal energy applied to said transfer film.

37. The method of claim 32, further comprising the steps of:

causing said thermal head and said print sheet to contact with each other; and increasing a time period during which the thermal head and the print sheet are in contact at each of a transfer start and a transfer completion, thereby increasing the quantity of thermal energy applied to said transfer film at each of the transfer start and transfer completion.

38. The method of claim 32, further comprising the steps of:

increasing at a transfer start a time period during which the thermal head and the print sheet are in contact, thereby increasing the quantity of the thermal energy applied at the transfer start.

39. The method of claim 32, further comprising the step of:

transferring an image to said dye-receptive layer to form said image in a smaller area than said dye-receptive layer.

40. The method of claim 39, further comprising the step of:

forming said image in said dye-receptive layer to a size smaller, by one to several print dots, than a size of said dye-receptive layer.

41. A method of producing a sheet with dye-receptive layers, comprising the steps of:

providing dye-receptive layers intermittently in sequence on an elongate dye-receptive layer transfer film, each of said dye-receptive layers having trailing edges;

providing, on an elongated print sheet, image forming regions each having a trailing edge, said dye-receptive layers having a width greater than corresponding image forming regions on said print sheet;

superposing said dye-receptive layer transfer film on said print sheet such that the trailing edges of said image forming regions coincide with, or overlap the trailing edges of corresponding dye-receptive layers formed on said transfer film;

transferring said dye-receptive layers from said dye-receptive layer transfer film to said print sheet by applying a quantity of thermal energy to said transfer film from a thermal head; and varying the quantity of thermal energy being applied with elapse of time.

42. A method of producing a sheet with a dye-receptive layer, comprising the steps of:

providing a dye-receptive layer transfer film having a dye receptive layer formed thereon;

superposing said transfer film on a print sheet;

applying a quantity of thermal energy to said transfer film from a thermal head to transfer said dye-receptive layer from said transfer film to said print sheet; and varying the quantity of thermal energy being applied with location.

43. A method of producing a sheet with a dye-receptive layer, comprising the steps of:

providing a dye-receptive layer transfer film having a dye-receptive layer formed thereon, said dye-receptive layer having a region with edge portions;

superposing said transfer film on a print sheet;

applying a quantity of thermal energy to said transfer film from a thermal head to transfer said dye-receptive layer from said transfer film to said print sheet; and causing the quantity of thermal energy being applied per unit area to be greater in said edge portions than in the remaining portion of said region.

44. The method of claim 43, wherein the thermal energy is applied to said edge portions by applying pulse voltage including a plurality of pulses to said thermal head and changing a width of each of the pulses.

45. The method of claim 43, further comprising the step of:

transferring an image to said dye-receptive layer to form said image in a smaller area than said dye,-receptive layer.

46. The method of claim 45, further comprising the step of:

forming said image in said dye-receptive layer to a size smaller, by one to several print dots, than a size of said dye-receptive layer.

* * * * *